United States Patent [19]

Skadeland

[11] 4,143,816

[45] Mar. 13, 1979

[54] FIREPLACE HEATING SYSTEM

[76] Inventor: David A. Skadeland, Rte. 5, Plantation Rd., Fayetteville, Ga. 30214

[21] Appl. No.: 687,376

[22] Filed: May 17, 1976

[51] Int. Cl.[2] ..... F24D 3/08; F24H 1/22; F28F 13/00

[52] U.S. Cl. ..... 237/8 R; 126/132; 126/140; 165/163; 165/DIG. 2

[58] Field of Search ..... 237/1 A, 8 R; 165/163, 165/145, 176, 178, DIG. 2; 126/132, 140

[56] References Cited

U.S. PATENT DOCUMENTS

| | | | |
|---|---|---|---|
| 2,143,287 | 1/1939 | Smith | 165/163 |
| 2,407,590 | 9/1946 | Vineberg | 126/140 |
| 2,664,275 | 12/1953 | Carter | 165/163 |
| 2,671,440 | 3/1954 | Dupler | 126/140 |
| 3,422,887 | 1/1968 | Berkeley | 165/163 |
| 3,746,084 | 7/1973 | Ostbo | 165/163 |
| 3,896,992 | 7/1975 | Borovina et al. | 237/8 R |
| 3,958,755 | 5/1976 | Cleer, Jr. | 237/8 R |
| 3,977,601 | 8/1976 | Bearzi | 237/8 R |

*Primary Examiner*—Henry C. Yuen
*Attorney, Agent, or Firm*—James B. Middleton

[57] ABSTRACT

A heating system including a fireplace and a flue for carrying away combustion products, door means being provided to prevent a draft through the space to be heated and to oxygen-starve a fire in the fireplace; and, heat exchanger means is mounted in the flue, the heat exchanger means comprising a plurality of coils for carrying a heat exchange medium, the coils being connected in parallel with one another on manifolds that extend through the coils.

2 Claims, 4 Drawing Figures

FIREPLACE HEATING SYSTEM

This invention relates generally to heating systems, and is more particularly concerned with a heating system having means to prevent heat loss due to fireplace draft and means for utilizing heat of the flue gases.

The basic arrangement comprising a chimney having fireplace therein, and a fire in the fireplace used to heat a living space has long been in general use. Equally as long, however, it has been realized that the fire radiates heat to warm what is in the vicinity of the fire but does not heat a large space very well. In addition, it has been realized that the fire heats the fireplace, so various attempts have been made to remove heat from the vicinity of the fireplace and use that heat to heat a living space. In all attempts to use a chimney with a fireplace for heating the living area, it has been found that there must be a proper draft through the chimney to assure that smoke and hot gases will go up the chimney rather than into the living area; and, it has been found that the same draft that causes the smoke to go up the chimney causes a general draft through the living area so that, though one may put heat into the living area, the heat is carried up the chimney along with the smoke.

Prior attempts to utilize heat from the fireplace have usually included some means for removing heat from the immediate vicinity of the fireplace. While a certain amount of heat can be so removed, if a large amount of heat is removed and/or if the fire is allowed to become very small, the removal of heat will cool the fire sufficiently to extinguish the fire. There have been some few attempts to remove heat from the flue gases, but these attempts have taken the form of a simple water jacket in a chimney in which the water is heated as the flue gases pass through, up the chimney. The flue gases are very hot so that an efficient system would heat water excessively causing dangerously high pressures, while an inefficient system is, by definition, rather wasteful.

The present invention overcomes the above-mentioned and other difficulties with the prior art systems and apparatus by providing a heating system including a chimney having a fireplace therein and a flue in communication with the fireplace for carrying smoke and hot gases through the chimney, the fireplace being provided with door means for substantially closing the fireplace and for isolating the fireplace from the living area to prevent a draft through the living area with the attendant heat loss. Also, the present invention includes a heat exchanger within the flue, the heat exchanger including multiple stages arranged in parallel to utilize a large quantity of heat from the flue gases without obtaining a great intensity of heat, and a heat dissipating means for transferring heat for use as desired.

These and other features and advantages of the present invention will become apparent from consideration of the following specification when taken in conjunction with the accompanying drawings in which.

Figure 1:
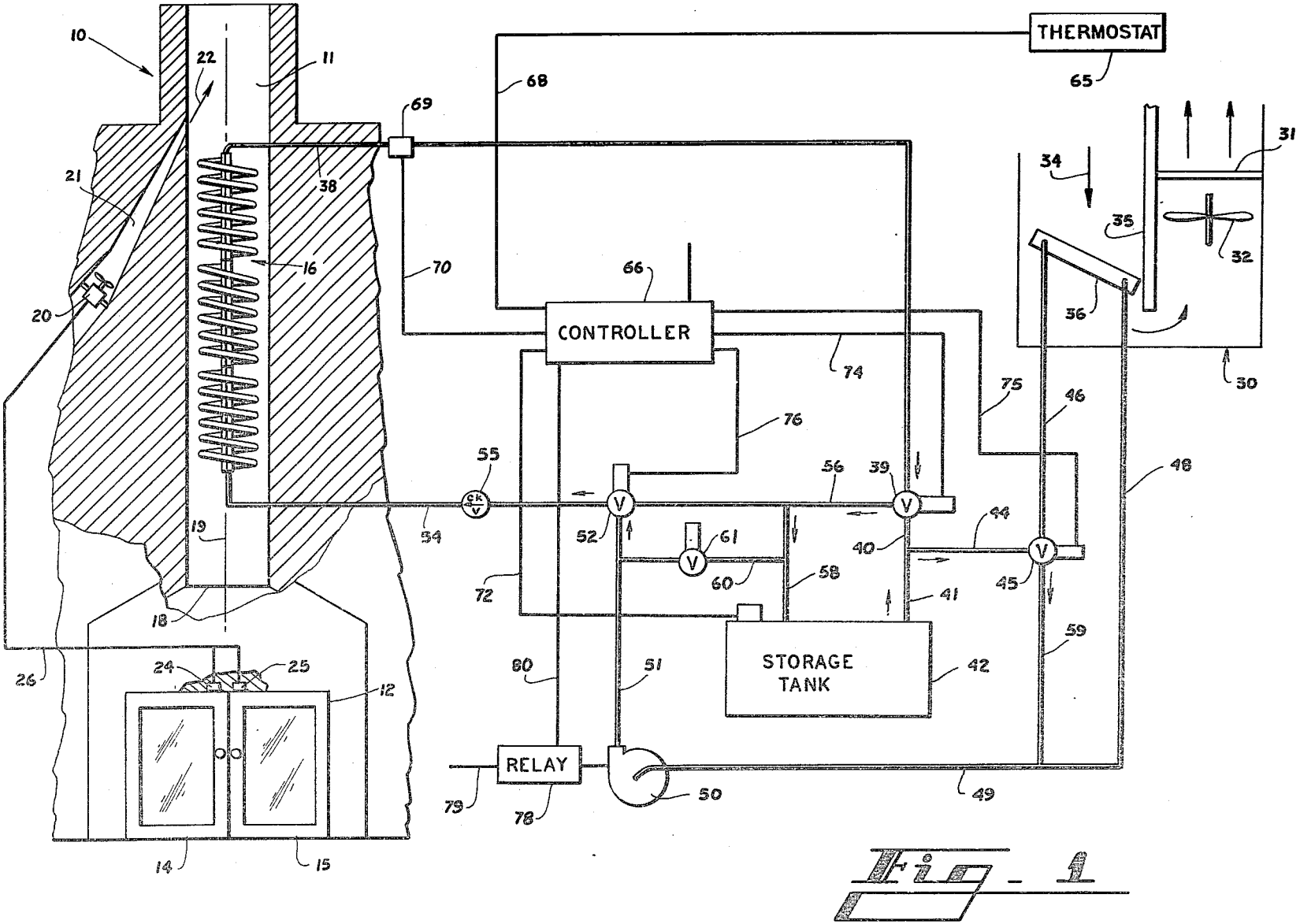
FIG. 1 is an illustration of a heating system made in accordance with the present invention, the illustration being largely schematic and showing both the fluid lines and the electrical lines.

Referring now more particularly to the drawings, and to that embodiment of the invention here chosen by way of illustration, it will be seen in FIG. 1 that the system includes a chimney 10 having a flue 11 and a fireplace 12. The fireplace 12 is substantially closed, and is separated from the living space by a pair of doors 14 and 15 which are here shown as glass doors, though it should be understood that any form of doors may be used. Glass doors tend to be desirable to allow one to monitor the fire visually without opening the doors 14 and 15.

Within the flue 11, there is a heat exchanger generally designated at 16, the specific construction of which will be discussed in detail hereinafter. At this time, however, it should be noted that the heat exchanger 16 is placed within the flue 11, but is above the junction 18 of the fireplace 12 and the flue 11 leaving an unobstructed column 19 immediately above the fireplace 12.

Before further discussion of the present system, it would be helpful to have a general understanding of the arrangement of the fireplace. It will be understood by those skilled in the art that a fire in the fireplace 12 will normally create an up-draft due to the fact that heat rises through the flue 11. This up-draft becomes sufficient to assure that smoke, hot gases, and generally the combustion products from the fire are carried through the flue 11 to be discharged. It is this same draft that usually carries heat from the living area and out the chimney to make a fireplace an inefficient heating means for a living area.

The present invention utilizes the doors 14 and 15 effectively to isolate the fireplace 12 from the living area, thereby preventing the large draft through the living space that normally results in heat loss from the living space. It is important to notice that the doors 14 and 15 do not contain dampers, louvers or the like, but are solid doors; and, it should be pointed out that the fireplace is not opened in any other direction so that the doors 14 and 15 substantially close off the fireplace. The effect is therefore both to stop the air flow from the living space through the fireplace and to oxygen-starve the fire in the fireplace 12. With the doors 14 and 15 closed as shown in FIG. 1 of the drawings, the fire in the fireplace 12 will be severely oxygen-starved so that the fire more nearly smolders than burns.

Due to the fact that the oxygen-starved fire in the fireplace 12 will have very little up-draft to carry smoke and other combustion products up the flue 11, there is an auxilary blower 20 provided to assist in smoke removal in the event that doors 14 and 15 are opened. Though numerous forms of blowers or the like may be effectively used, the arrangement here shown includes the blower 20 arranged to direct air through the passageway 21 in order to create a relatively high velocity stream up the flue 11 as indicated by the arrow 22. It will be understood by those skilled in the art that, with the high velocity stream as indicated by the arrow 22, relatively still air will tend to move into the side of the moving stream so that a column of air will be caused to move up the flue 11 creating the draft necessary to remove smoke from the fireplace 12.

Since the blower 20 is not required when the doors 14 and 15 are closed, there is a pair of switches 24 and 25 adjacent to the doors 14 and 15 respectively, the switches 24 and 25 being connected through a cable 26 to the blower 20. It will be understood that the switches 24 and 25 are connected in parallel so that if either switch 24 or 25 is closed, the blower 20 will be energized; therefore, if either of the doors 14 or 15 is opened even slightly, the appropriate switch 24 or 25 will be closed to cause operation of the blower 20 and create sufficient up-draft through the flue 11 to remove smoke and other combustion products from the fireplace 12.

Though the provision of the blower 20 is an assurance that the living space will not be filled by smoke on opening of one of the doors 14 or 15, it will be understood that, if one opens a door only very slightly, a fire smoldering within the fireplace 12 will receive additional oxygen and will burn more vigorously, thereby creating an up-draft. By so using the doors 14 and 15, it will be seen that an up-draft can be created by a fire rather than requiring the blower 20, or some comparable smoke removal means.

Looking now at the rest of FIG. 1 of the drawings, the heating system is here shown as used in conjunction with a conventional forced air furnace 30 having some form of heating means 31 and a blower indicated at 32. As here shown, the blower 32 would remove air from the living space and direct the air as indicated by the arrow 34, around the baffle 35, and up through the heating means 31 to return to the living space. Within the return air space, there is placed a heat exchanger 36 which is the heat dissipating means for heat collected by the heat exchanger 16 within the flue 11.

From the top-most end of the heat exchanger 16, there is a pipeline 38 which is the discharge line from the heat exchanger 16. It will therefore be seen that hot water (or other heat exchange medium) is directed through the pipe 38 to the valve 39. Assuming the valve 39 is approximately actuated, the hot water will pass through the valve 39 to the pipe 40. It will be seen that the pipe 40 has one branch 41 connected to a storage tank 42 and another branch 44 connected to a valve 45. Assuming temporarily that the storage tank 42 is closed off so that water will not pass through the line 41 into the tank 42, it will be understood that the water will pass from the line 40 into the branch 44 and to the valve 45. With the valve 45 appropriately operated, the water will then pass into the line 46 and to the heat exchanger 36, pass through the heat exchanger 36 and back to the line 48. It will now be seen that the line 48 is connected to the suction line 49 of a pump 50. The high pressure side of the pump 50 is connected to a pipe 51 which leads to a valve 52, the valve 52 being appropriately operated to direct the water from the line 51, through the valve 52 and to the line 54 which contains a check valve 55. It will be understood that the check valve 55 is arranged to allow water to flow from the valve 52 towards the heat exchanger 16, but not in the opposite direction. It will therefore be seen from the above description that water can be heated in the heat exchanger 16, and with appropriate arrangement of the valves 39, 45 and 52, the water will be passed through the heat exchanger 36 and be dissipated to air for the living space, then the water will return through the pump 50 and back to the heat exchanger 16 to be reheated.

It has been found that, when a fire of any appreciable size is maintained in the fireplace 12, a surplus of heat is generated in the flue 11 and picked up by the heat exchanger 16. Since, as previously mentioned, it would be dangerous to heat the water to an excessively high temperature because dangerously high pressures would be achieved, it has been found desirable to utilize the storage tank 42 which allows a quantity of heat to be stored for future use. Thus, if it is assumed that the living space is well heated and does not require additional heat, but the fire in the fireplace 12 is producing heat that is picked up by the heat exchanger 16, all of the heat picked up by the heat exchanger 16 will be stored. For this arrangement, the water will pass, as before, through the pipe 38 and to the valve 39. As before, the valve 39 will allow the water to pass from the pipe 38, through the valve 39; however, the valve 39 will be operated so that water will pass through the valve 39 to a pipe 56, then through the branch pipe 58 into the storage tank 42. To allow the water to flow into the storage tank 42, the water will also be able to flow out of the tank, through the line 41 and through the branch line 44, then through the valve 45 which will be operated to allow the water to pass from the pipe 44, through the valve 45 and to the branch line 59, thence to the pipe 49 into the suction side of pump 50. The high pressure side of the pump 50, as before, directs water through the pipe 51, then through the valve 52 which would be, again, operated to allow the water to pass through the valve 52 into the line 54 to return to the heat exchanger 16. In this way, it will be understood that heat is picked up from the flue gases by the heat exchanger 16, and circulated through the storage tank 42 to heat the water within the storage tank 42. With sufficient operation, it will be understood that all of the water in the storage tank 42 will be heated to the maximum temperature for which the system is designed so that this heat could later be used to heat the living space when there is no fire in the fireplace 12.

It will be understood that, at times, heat will be required in the living space so that it will be desirable to pass heated water through the heat dissipating heat exchanger 36, but an excessive amount of heat will be picked up by the heat exchanger 16 so that it will be desirable to put some of the heat into the storage tank 42. For this condition, it will be seen that the circuit for heated water will be as previously described; however, there is a bypass line 60 having a thermostatically operated valve 61 with a heat sensing line 62. It will therefore be seen that, with the valve 61 open to allow water to pass through the line 60, water will be able to pass through a pipe 40 and into the branch 41 to go into the tank 42, thence out of the tank 42 through the pipe 58 and through the pipe 60 to return to the pipe 51, through the valve 52 and back to the heat exchanger 16. The heat sensor 62 is placed on the pressure side of the pump 50 which is, in effect, the return water from the heat exchanger 36. It will therefore be seen that, when the return water from the heat exchanger 36 is above some predetermined temperature, the valve 61 will be opened to allow water to pass into the storage tank 42.

Attention is next directed to the electrical control means for the various pieces of apparatus shown in FIG. 1. It will first be seen that there is a thermostat 65 in the living space, the thermostat 65 being of virtually any well-known design wherein a switch is closed when the setting of the thermostat is above the room temperature. The thermostat 65 is connected to a central control box 66 by a line 68. The next sensing means is a sensing device 69 placed in the pipe 38 or other convenient location to detect the temperature of water as it emerges from the heat exchanger 16. It is contemplated that the heat sensing device 69 will be in the form of a thermister wherein a current is passed through a device, the electrical resistance of the device varying in accordance with the temperature so that the electrical current through the thermister is an indication of the temperature. Such apparatus is well-known to those skilled in the art, and no further description is thought to be necessary. The thermister 69 is also connected to the control box 66 by a line 70.

The next sensing device is a sensor 71 placed on the storage tank 42 to detect the temperature of the water within the storage tank 42. It is contemplated that the sensing device 71 will also be a thermister, and it will be connected to the control box 66 by a line 72.

It will therefore be seen that the control box 66 includes the three sensors 65, 69 and 71; and, the control box, based on the input from the sensors, controls the valve 39 through the electrical line 74, controls the valve 45 through the line 75, and controls the valve 52 through the line 76. Additionally, there is a relay 68 which, when energized, will connect the pump 50 to a voltage source 79, and the relay 78 is energized through a control line 80 from the control box 66.

From the foregoing, it should be understood that the thermostat 65 can be appropriately set to the desire temperature of the living space. When the thermostat 65 indicates that heat is required in the living space, the control box 66 will determine the temperature of the hot water from the heat exchanger 16, will determine the temperature of the storage tank 42, and will adjust the valves 39, 45 and 52 appropriately to allow hot water to be passed through the heat exchanger 36 to heat the living space. If no additional heat is required in the living space, the switch in the thermostat 65 will be opened; however, if there is an excess of heat picked up by the heat exchanger 16, the relay 78 will be energized to cause the pump 50 to operate but the valves 39, 45 and 52 will be appropriately operated to direct heat from the heat exchanger 16 into the storage 42 for use later.

Figure 2:
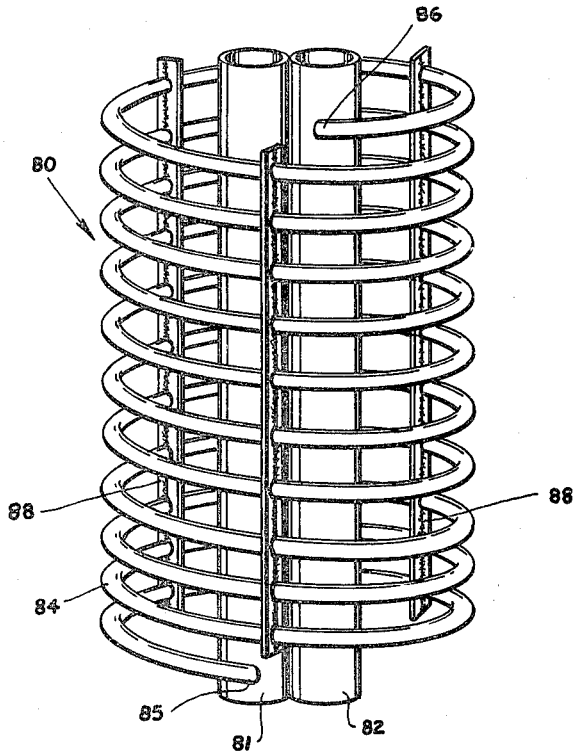
FIG. 2 is a perspective view showing a single stage of a heat exchanger made in accordance with the present invention.
Figure 3:
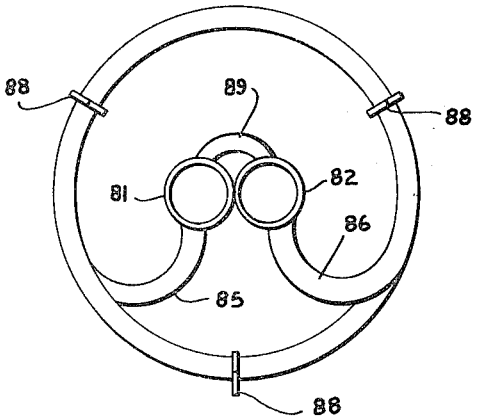
FIG. 3 is a top plan view of the device shown in FIG. 2 of the drawing.

Attention is next directed to FIGS. 2 and 3 of the drawings which show a single stage of a heat exchanger apparatus. In FIG. 2, the device 80 includes a first manifold 81 to receive the cold, or lower temperature, water or other fluid, the manifold 81 being generally parallel to a manifold 82. The manifold 82 is to receive the hot, or higher temperature, water. It will be seen that there is a coil 84 surrounding the manifolds 81 and 82 in helical fashion. The lower end of the coil 84 is connected to the manifold 81 as at 85 so that, with high pressure fluid within the manifold 81, the fluid will pass into the junction 85 to enter the coil 84. At the uppermost end of the coil 84, it will be seen that there is a junction 86 with the manifold 82 so that, under high pressure of the manifold 81, fluid will pass through the coil 84, through the junction 86 and into the manifold 82.

Looking at FIG. 3 of the drawings, it will be seen that there is a plurality of coil supports 88. These coils supports 88 are arranged to maintain appropriate separation between convolutions of the coil 84 so that maximum surface will be maintained in order to pick up heat from the surrounding atmosphere. As shown in FIG. 3, there is a cross-over tube 89 which simply connects the manifold 81 to the manifold 82. Though such a cross-over tube 89 may not be required, if the temperature of water being discharged from the heat exchanger 16 becomes too high, the cross-over 89 may be required in order to dilute the heated water in the manifold 82 with the unheated water from the manifold 81 in order to lower the temperature of the high temperature water.

Figure 4:
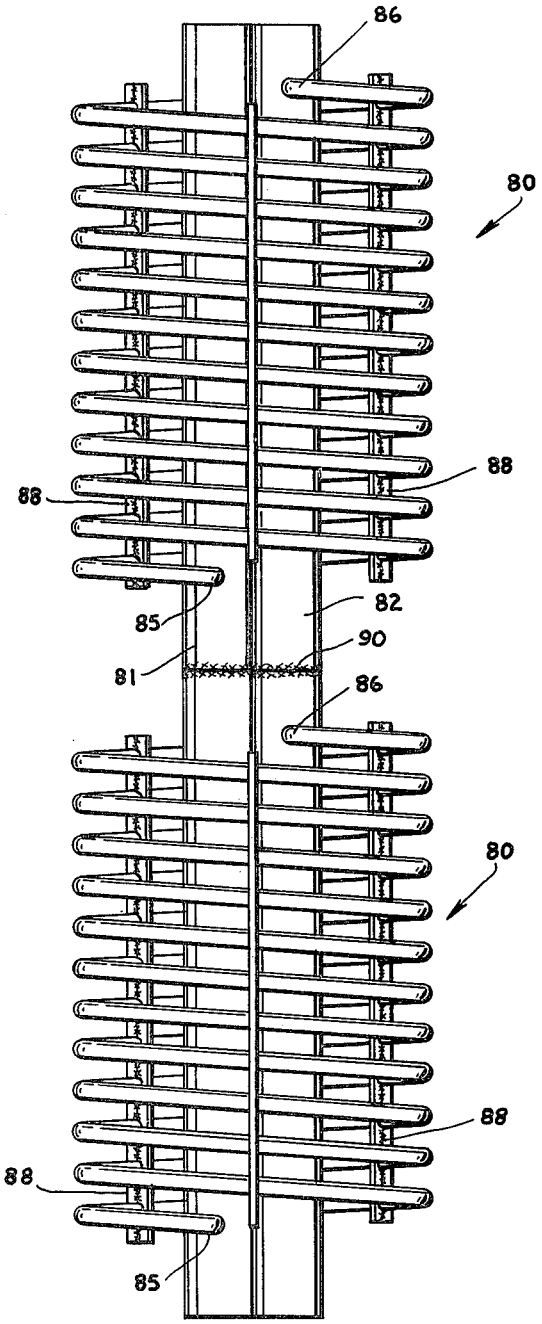
FIG. 4 is a front elevational view showing a plurality of heat exchanger units, such as the units shown in FIGS. 2 and 3, connected together to provide a plurality of parallel stages.

Looking then at FIG. 4 of the drawings, it will be seen that two of the stages 80 have been fixed together, here shown as butt welded as at 90 to provide a two stage heat exchanger. It will be seen that the entrance end 85 of the coil 84 is always on the high pressure, or low temperature, manifold 81 so that in multiple stages the individual stages 80 will always be connected in parallel rather than in series. This has been found especially desirable because the heat exchanger 80 is so efficient in picking up heat from the hot gases in the flue 11 that additional coil length, as would be the case if the stages were connected in series, causes a water temperature in excess of that which is desirable. Therefore, it will be seen that the present heat exchanger stage 80 can be multiplied to achieve a greater volume of water through the heat exchanger without increasing the temperature of the water. It will of course be understood that when a larger space is to be heated, the important consideration is the quantity of heat rather than the intensity of heat, greater efficiency being had by maintaining a lower temperature difference between a heat exchange medium and a space to be heated since a greater temperature difference between the heat exchange medium and the space to be heated simply results in loss of heat along the pipelines.

It will therefore be seen that the present invention provides an admirably adaptable heat exchange device for acquiring heat from flue gases or other relatively hot area, the heat exchange device being installable in a plurality of sections to match the need in the particular heating system. The system utilizing the heat exchange device is admirably adapted to use with a conventional forced air furnace or, it will of course be understood that the heat dissipating heat exchanger can be provided with its own fan and ductwork. It is especially important in the present invention to utilize the fireplace having means for closing off the fireplace from the living area to prevent the draft that causes heat from the living area to go up the flue and thereby cool the living space. The overall combination of the doors to prevent the draft through the living area and the heat exchanger to acquire heat from the flue provides an admirable system that is highly efficient and easy to use.

It should also be understood that the system of the present invention effects almost startling fuel savings. Since the fire is severely oxygen starved, wood in the fireplace burns almost imperceptibly and requires much time to consume a log. The fire is not as hot as the usual fire, and the slow burning appears to achieve more nearly complete burning so that carbon, or soot, deposits in the chimney are lessened. Furthermore, the logs are intended to burn slowly, or smolder, so larger logs can be used, thereby obviating the necessity to split larger logs before burning them. Thus, one will normally realize 50 to 75% fuel savings in using the system of the present invention, and one installation has achieved as high as 80 to 90% fuel savings. There are of course many variables, so an exact figure cannot be given.

It will of course be understood that the embodiment of the invention here shown is by way of illustration only, and is meant to be in no way restrictive; therefore, numerous changes and modifications may be made, and the full use of equivalents resorted to, without departing from the spirit or scope of the invention as defined by the appended claims.

I claim:

1. In a heat exchange system wherein relatively hot gases pass through a flue, a first heat exchanger is disposed in said flue with a heat exchange medium flowing therethrough for absorbing heat from said relatively hot gases, a second heat exchanger is disposed in a relatively cool area, and said second heat exchanger is communicably connected with said first heat exchanger so that said heat exchange medium flows through said second heat exchanger for dissipating heat from said heat exchange medium, the improvement wherein said first heat exchanger comprises a first manifold for receiving said heat exchange medium from said second heat exchanger, a single helical coil having a first lower end fixed in communication with said first manifold for receiving said heat exchange medium from said first manifold, and a second upper end, a second manifold adjacent and parallel to said first manifold, said second upper end of said single helical coil being fixed in communication with said second manifold so that said second manifold receives said heat exchange medium from said single helical coil, and coil support means for maintaining successive convolutions of said single helical coil in spaced relation with respect to one another, said first manifold and said second manifold being so constructed and arranged as to receive a like pair of manifolds in end-to-end relationship therewith, said like pair of manifolds having a second single helical coil therearound and in communication therewith, said single helical coil and said second single helical coil being two of a plurality of single helical coils, all of said plurality of single helical coils being co-axially positioned in said flue, each of said plurality of single helical coils having a first end fixed to said first manifold and a second end fixed to said second manifold so that said plurality of single helical coils are connected in parallel with one another.

2. A heat exchanger as claimed in claim 1, and further including at least one cross-over connected between said first manifold and said second manifold.

* * * * *